US008028624B2

(12) United States Patent
Mattson

(10) Patent No.: US 8,028,624 B2
(45) Date of Patent: Oct. 4, 2011

(54) ROCK-BLASTING CARTRIDGE AND BLASTING METHOD

(75) Inventor: Thomas Mattson, Glis (CH)

(73) Assignee: Mattson Inter Tool GmbH, Brig (CH)

( * ) Notice: Subject to any disclaimer, the term of this patent is extended or adjusted under 35 U.S.C. 154(b) by 239 days.

(21) Appl. No.: 12/449,243

(22) PCT Filed: Feb. 2, 2007

(86) PCT No.: PCT/CH2007/000052

§ 371 (c)(1),
(2), (4) Date: Jul. 30, 2009

(87) PCT Pub. No.: WO2008/092282

PCT Pub. Date: Aug. 7, 2008

(65) Prior Publication Data

US 2010/0089270 A1 Apr. 15, 2010

(51) Int. Cl.
*F42B 3/02* (2006.01)

(52) U.S. Cl. ..... 102/317; 102/320

(58) Field of Classification Search ..... 102/317–333
See application file for complete search history.

(56) References Cited

U.S. PATENT DOCUMENTS

| | | | | |
|---|---|---|---|---|
| 2,887,953 | A * | 5/1959 | Mager | 102/317 |
| 3,195,928 | A * | 7/1965 | Pasternack | 285/18 |
| 4,015,526 | A * | 4/1977 | Bond et al. | 181/116 |
| 4,037,536 | A * | 7/1977 | Griffith | 102/331 |
| 4,313,380 | A * | 2/1982 | Martner et al. | 181/116 |
| 4,382,410 | A | 5/1983 | Bowling et al. | |
| 5,212,342 | A * | 5/1993 | Eches et al. | 102/317 |
| 6,516,725 | B2 * | 2/2003 | Jackson et al. | 102/471 |

FOREIGN PATENT DOCUMENTS

| | | |
|---|---|---|
| AU | 37752/72 | 7/1973 |
| GB | 2 131 924 A | 6/1984 |
| WO | WO 00/31495 A1 | 6/2000 |
| WO | WO 03/004960 A1 | 1/2003 |
| WO | WO 2005/088236 A1 | 9/2005 |

* cited by examiner

*Primary Examiner* — Michael David
(74) *Attorney, Agent, or Firm* — The Nath Law Group; Jerald L. Meyer; Robert T. Burns

(57) ABSTRACT

A blasting cartridge comprising an elongated sleeve extending along an axis A and having a first end and a second end; the first end has a first sleeve closure with an opening for holding a detonator; the second end has a second sleeve closure; a space is provided between the first sleeve closure and the second sleeve closure for holding a blasting explosive; wherein the second end is provided with a connector means for releasably connecting the second end of the cartridge with a first end of an adjacent cartridge and comprising a firing pin means for impinging upon a detonator in the first end of the adjacent cartridge when the blasting explosive is detonated by actuation of the detonator in the first end of the cartridge.

10 Claims, 1 Drawing Sheet

Fig. 1A
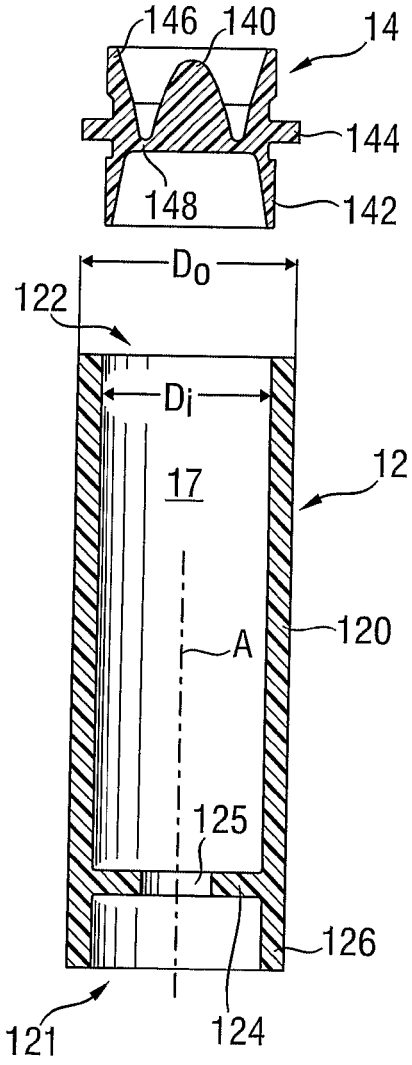
Fig. 1B
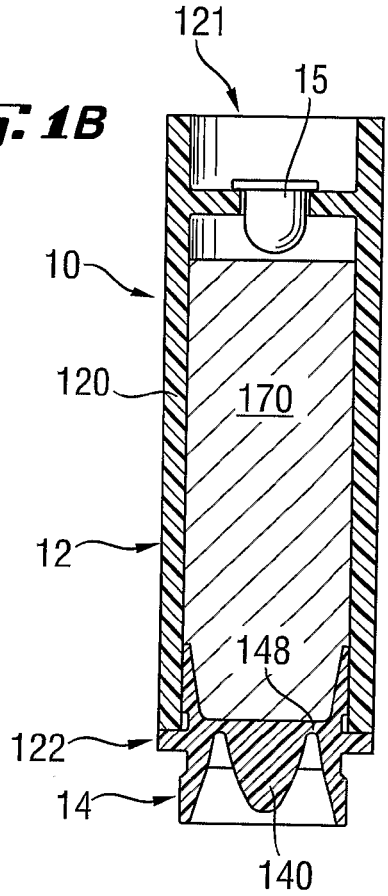
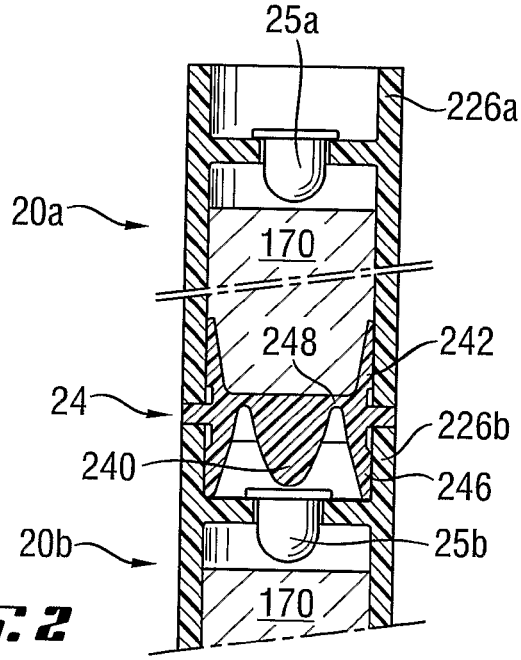
Fig. 2

ROCK-BLASTING CARTRIDGE AND BLASTING METHOD

This is a National Phase Application filed under 35 U.S.C. §371 as a national stage of PCT/CH2007/000052, with the filing date of Feb. 2, 2007, which is hereby incorporated by reference in its entirety.

This subject matter relates to blasting cartridges used in rock breaking methods such as disclosed, for example, in U.S. Pat. No. 4,382,410 or EP 248 610. In such methods, a hole is drilled into the rock and after inserting one or more blasting charges the hole is filled with water, and a so-called rock breaking tool is inserted into the hole. If the rock is porous, a gel-forming agent may be added to the water. The tool can be operated to detonate the blasting charge, generally by igniting a primary or starter charge arranged within the tool and generating a shock wave which is propagated by the water and ignites the cartridges that constitute the actual or secondary charge within the water-filled hole.

Various and widely differing types of cartridges for the secondary charge are known. More recent cartridge types are disclosed in U.S. Pat. No. 6,516,725 where each cartridge is provided with a detonator (also termed percussion cap) and a firing pin body, or in WO 2005-088236 where the cartridges are provided with protrusions at one of their ends to assure that the igniting shock produced in the water by the primary charge has free access to the ignition-sensitive portion of the secondary blasting cartridge or cartridges.

Yet, none of the known types of cartridges guarantees safe ignition if several cartridges are arranged one behind the other in the bore hole. The exemplary embodiments disclosed below provide for a blasting cartridge where failure to ignite the cartridge most remote from the primary charge virtually is excluded even if a large number of cartridges is required for a given operation. Other non-limiting exemplary embodiments disclosed below form coherent elongated bodies of several cartridges to facilitate handling, e.g. when charging the hole drilled into the rock or when the need arises to withdraw a charge without ignition.

Now, in order to meet theses objectives, a blasting cartridge is shown and described below.

For example, an exemplary embodiment provides for a blasting method wherein a blasting explosive is positioned within a tubular hole drilled into a rock and initiated by a primary charge for actuation of a plurality, e.g. 2-8, of interconnected blasting cartridges according to the exemplary embodiments disclosed below. Preferably, the cartridges fit snugly into the hole drilled into the rock, typically with a gap of only a few millimeters. As is conventional, the inter-space between the cartridges and the rock is filled with an aqueous medium which may contain a thickener or gel-former if the rock is porous.

Generally, the blasting cartridge according to these non-limiting exemplary embodiments has an elongated and preferably tubular or cylindrical sleeve; reference to the axis serves for purposes of clear definition and relates to the geometric axis along the longest extension of the cartridge.

The cartridge has a first or "upper" end and a second or "lower" end, and each end is provided with a closure. The terms "upper" and "lower" are subjective, of course, but serve as non-limiting examples of cartridges intended for use in rock blasting where a hole is drilled into the rock and the charge is inserted so that each lower end of a cartridge is more remote from the opening of the hole than the upper end of the same cartridge.

Each first end of a cartridge holds a detonator or percussion cap such as used with the cartridges which is sensitive to the shock of a firing pin. Centre-fire detonators are preferred over rim-fire detonators herein. The closure of the cartridge adjacent the upper end is a radially extending wall with a central opening that receives and holds the detonator.

Each second end of a cartridge is provided with a connector means for releasably connecting the second or lower end of the cartridge with a first end or upper end of an adjacent cartridge and comprises a firing pin means for impinging upon a detonator in the first end of an adjacent cartridge.

The space between said first sleeve closure and said second sleeve closure of the cartridge contains a conventional blasting explosive, preferably one having an energy of 4000-5000 Joule/g. Actuation of the detonator means triggers the ignition of the blasting explosive.

Typically, blasting cartridges are used in the manner disclosed in WO2005/088236 mentioned above, i.e. as a "cracker" or "secondary" charge which typically is ignited by a smaller cartridge termed "starter" of the conventional shotgun type as shown, for example, in U.S. Pat. No. 5,670,737. Suitable starter cartridges are well known in the art and are available commercially so that a more detailed explanation of their structure and associated firing apparatus are not discussed herein.

While the connector according to the disclosed exemplary embodiments could be an integral part of the cartridge, or cartridge sleeve, respectively, it is most preferably used in the form of a separate integral or "monolithic" structure made of a synthetic polymer, typically a thermoplastic polymer such as a polyamide, polyalkylene, polystyrene, ABS-resin, polyurethane, or the like material containing the usual fillers, additives, stabilizers, pigments, etc., shaped e.g. by injection moulding or other shaping methods. The sleeve can be made of the same material as the connector or a differing material of the type conventionally used for blasting cartridges.

A preferred embodiment will be explained in more detail below and with reference to the drawing in which:

FIG. 1A is a cross-sectional semi-diagrammatic view of the sleeve of a cartridge in upside-down position prior to its assembly with the detonator and blasting explosive and with the connector shown separately on top;

FIG. 1B is a cross-sectional view of the cartridge components in a fully assembled state; and FIG. 2 is a semi-diagrammatic view of two adjacent cartridges in their inter-connected state.

The blasting cartridge depicted in FIG. 1A comprises an elongated cylindrical sleeve 12 that extends along its longitudinal axis A and has an outer diameter $D_o$ and an inner diameter $D_i$. Typically, $D_o$ is in the range of from about 20-50 mm, e.g. 35 mm. The thickness of sleeve wall 120 typically is in the range of from about 1-5 mm resulting in an inner diameter in the range of from about 22-48 mm.

Due to the upside-down showing of FIG. 1A, the connector 14 is shown near the second or lower end 122 prior to insertion of connector 14 into sleeve 12 so as to eventually form the "lower" end of space 17 prior to filling that space with blasting explosive, typically a granulate. Finally, detonator or (a "percussion cap") 15 is inserted into the circular opening at the centre of radially extending wall 124 which is offset in axial direction so as to form a collar 126 around detonator 15.

Connector 14 has a flange portion 144 with the same diameter as sleeve 12 so as to limit motion of a generally tubular end 142 of connector 14 when pressed into sleeve 12. Dimensions and shape of end 142 are selected to ascertain a tight fit in the lower end 122 of sleeve 12 so that it will not be separated easily—and may even be glued or welded if required—and in any case will maintain its connection with sleeve 12 even when two cartridges are connected (as indicated in FIG. 2) and separated again, e.g. if an assembled blasting charge consisting of two or more connected cartridges is to be disassembled.

Bulge 140 of connector 14 serves as a "firing pin" means where the word "pin" is used herein merely as a functional term and not to define a shape. In fact, what is meant herein by the term "firing pin" is a firing actuator, i.e. the part which impinges on the detonator of an adjacent cartridge (FIG. 2). Preferably, the annular portion 148 around bulge 140 is the thinnest part of the outer wall of the final cartridge (FIG. 1B) so that separation of the firing pin means will occur most easily upon blasting. Connector 14 is provided with a second tubular protrusion 146 for connection with an adjacent cartridge as will be explained in connection with FIG. 2. Generally, portion 148 will be at least about 10% thinner than any other portion of the outer wall of cartridge 10, preferably at least 20%.

FIG. 1B shows a fully assembled blasting cartridge 10 according to the exemplary embodiment shown. Typically, a detonator 15 is inserted into opening 125 so as to close the associated end of sleeve 12. Blasting explosive 170, typically a commercially available granular or pulverulent material, is poured into space 17 and connector 14 is inserted into the sleeve, e.g. by pressing to arrive at the structure of cartridge 10 depicted in FIG. 1B.

FIG. 2 is a semi-diagrammatic sectional view showing a first cartridge 20*a* (with its central portion broken away) connected with a second cartridge 20*b* (only upper portion shown in FIG. 2). As is apparent from FIG. 2, collar 226*b* (which corresponds with collar 126 of FIG. 1A) cooperates with the protruding portion 246 (corresponding with 146 in FIG. 1A) to hold both cartridges 20*a*, 20*b* connected while maintaining a predetermined distance between the end of firing pin 240 and detonator 25*b* of the adjacent cartridge 20*b*. Collar 246 will also serve to protect firing pin 240 from damage upon storage or handling while collar 226*a* (or 126 in FIG. 1A) serves to protect detonator 25*b*.

As will be apparent from FIG. 2, the gap between firing pin 240 and detonator 25*b* can be determined by either or both the axial length of collar 246 and the axial length of collar 226*b*.

Various modifications will be apparent to those experienced in the art of rock blasting. For example, while drill holes in the suitable for filling with water, i.e. "downward-directed", are preferred; upwards directed holes in rock could be used and filled with a fluid composition capable of solidifying within a short time, e.g. because of catalyst action. Also, whenever the term "about" or an equivalent indefinite term is used herein, this indicates a possible variation by +/−30%.

The invention claimed is:

1. A blasting cartridge comprising:

an elongated sleeve extending along an axis A and having a first end and a second end, said first end having a first sleeve closure and an opening for holding a detonator and said second end having a second sleeve closure; and a space between said first sleeve closure and said second sleeve closure for holding a blasting explosive; wherein:

said second end is provided with a connector and configured for releasably connecting said second end of said cartridge with a first end of an adjacent cartridge:

said elongated sleeve has an essentially cylindrical shape with an outer diameter Do and an inner diameter Di; and wherein said connector is a separate monolithic member comprising:

a flange having the same radial diameter D as said sleeve;

a first connecting member extending essentially in a first axial direction from said flange and configured for tightly inter-fitting with said second end of said sleeve;

a second connecting member extending essentially in a second axial direction opposite said first axial direction from said flange and configured for tightly inter-fitting with a first end of an adjacent blasting cartridge; and a firing pin for actuating a detonator in a first end of an adjacent cartridge; and wherein said sleeve at said first end forms a collar configured for receiving and tightly holding said second connecting member while maintaining a predetermined gap between said firing pin and an adjacent detonator.

2. The blasting cartridge of claim 1 wherein said firing pin is a protrusion surrounded by an annular region which is thinner by at least about 10% than any wall of said cartridge.

3. The blasting cartridge according to claim 2, wherein said detonator is a center-sensitive detonator.

4. The blasting cartridge according to claim 2, wherein said connector is comprised of a synthetic polymer.

5. The blasting cartridge according to claim 1, wherein said detonator is a center-sensitive detonator.

6. The blasting cartridge according to claim 5, wherein said connector is comprised of a synthetic polymer.

7. The blasting cartridge according to claim 5, wherein said firing pin is a protrusion surrounded by an annular region which is thinner by at least about 10% than any wall of said cartridge.

8. The blasting cartridge according to claim 1, wherein said connector is comprised of a synthetic polymer.

9. The blasting cartridge of claim 8 wherein said firing pin is a protrusion surrounded by an annular region which is thinner by at least about 10% than any wall of said cartridge.

10. The blasting cartridge according to claim 8, wherein said detonator is a center-sensitive detonator.

* * * * *